US011805867B2

(12) United States Patent
Ziegenbein

(10) Patent No.: US 11,805,867 B2
(45) **Date of Patent: *Nov. 7, 2023**

(54) SYSTEM AND METHOD FOR ENHANCING THE UTILITY OF SMARTWATCHES IN COMBINATION WITH MECHANICAL AND OTHER CONVENTIONAL WATCHES

(71) Applicant: Keith J. Ziegenbein, Ashland, NE (US)

(72) Inventor: Keith J. Ziegenbein, Ashland, NE (US)

(73) Assignee: Francois R. Girardet, Neuchatel (CH)

( * ) Notice: Subject to any disclaimer, the term of this patent is extended or adjusted under 35 U.S.C. 154(b) by 164 days.

This patent is subject to a terminal disclaimer.

(21) Appl. No.: 17/300,527

(22) Filed: Aug. 3, 2021

(65) Prior Publication Data

US 2021/0386161 A1 Dec. 16, 2021

Related U.S. Application Data

(63) Continuation-in-part of application No. 16/602,776, filed on Dec. 9, 2019, now Pat. No. 11,103,033.

(60) Provisional application No. 62/919,526, filed on Mar. 18, 2019.

(51) Int. Cl.

| | |
|---|---|
| ***A44C 5/14*** | (2006.01) |
| ***G04G 17/08*** | (2006.01) |
| ***A44C 5/24*** | (2006.01) |

(52) U.S. Cl.

CPC ..... *A44C 5/147* (2013.01); *A44C 5/24* (2013.01); *G04G 17/08* (2013.01)

(58) Field of Classification Search

CPC ..... A44C 7/003; A44C 5/00; A44C 5/003; A44C 5/147; A44C 5/22; A44C 5/243; A44C 5/246; A44C 5/14; A44C 5/0015; G04B 37/1486

See application file for complete search history.

(56) References Cited

U.S. PATENT DOCUMENTS

| | | | | |
|---|---|---|---|---|
| 2,749,634 | A * | 6/1956 | Billett | A44C 5/0015 40/728 |
| 3,924,304 | A * | 12/1975 | Grandmont | A44C 5/003 24/3.2 |
| 9,152,129 | B2 * | 10/2015 | Modaragamage | G04G 9/00 |
| 9,439,480 | B1 * | 9/2016 | French | A44C 5/0053 |
| 2009/0207701 | A1 * | 8/2009 | Jacques | G04G 17/083 368/242 |
| 2015/0085623 | A1 * | 3/2015 | Modaragamage | G04G 17/045 368/10 |
| 2015/0296963 | A1 * | 10/2015 | Byun | G04G 17/08 224/191 |
| 2016/0143403 | A1 * | 5/2016 | Pluemer | A44C 5/00 224/267 |
| 2016/0249712 | A1 * | 9/2016 | Pluemer | A44C 5/14 224/164 |
| 2018/0213895 | A1 * | 8/2018 | Green | A44C 5/2071 |
| 2019/0064743 | A1 * | 2/2019 | Clark | G04B 37/1486 |

* cited by examiner

*Primary Examiner* — Jack W Lavinder
(74) *Attorney, Agent, or Firm* — James D. Welch

(57) ABSTRACT

A system, and method for enhancing the utility inherent in the application of smartwatches, in functional combination with conventional watches, in a single watchband.

23 Claims, 5 Drawing Sheets

SYSTEM AND METHOD FOR ENHANCING THE UTILITY OF SMARTWATCHES IN COMBINATION WITH MECHANICAL AND OTHER CONVENTIONAL WATCHES

This Applications is a CIP or Ser. No. 16/602,776 filed Dec. 9, 2019, and therevia Claims benefit of 62/919,526 filed Mar. 18, 2019.

TECHNICAL FIELD

The present invention relates to watchbands and watches, and more particularly to a system and method for enhancing the utility inherent in the application of smartwatches in functional combination with conventional (eg. typically mechanical) watches secured by a single watchband.

BACKGROUND

It has been common practice for people to wear conventional watches for at least a century, and more recently that practice has included the wearing of smartwatches, which are wearable devices in the form of a wristwatch for use in accessing the Internet, or connecting to an Internet enabled device such as a smartphone to provide additional features, besides simply keeping time. Many people still prefer their conventional watches because of their styling and quality etc., but some of those same people also desire the benefits offered by smartwatches. In response, various watch manufacturers have offered a watch system that enables a watchband that simultaneously secures two watches to a user's wrist, one being a conventional type, and one being a smartwatch. The available systems are often bulky and not particularly aesthetic, however. In such systems the typically larger dial of a conventional watch can be worn facing upward for easy viewing, while the smartwatch can be positioned to face downward, (ie. in the direction the palm of a user's hand). Both watches are easily accessible for viewing, requiring only that a user rotate his or her wrist. A major problem with the presently available dual watch systems however, is that the manufacturer thereof dictates the combination of watches, which are both firmly secured to the watchband.

A Search of Patents and Published Applications turned up the following:

U.S. Pat. No. 9,833,048 to Rivera;
U.S. Pat. No. 9,723,899 to Modaragamage;
U.S. Pat. No. 9,551,978 to Modaragamage;
U.S. Pat. No. 9,152,129 to Modaragamage;
U.S. Pat. No. 7,618,269 to Daniel et al.;
U.S. Pat. No. 4,786,981 to Rodman;
U.S. Pat. No. 3,924,304 to Grandmont;
U.S. Pat. No. 3,293,846 to Heinz;
U.S. Pat. No. 2,954,622 to Moore;
U.S. Pat. No. 1,485,915 to Monroe;
US2016/143404 by Pluemer et al.;
US2016/0066660 by Pluemer;
US2013/0223195 by Loetscher;
US2013/0206801 by Delgatty;
US2009/0173760 by Good;
US2007/0279852 by Daniel et al.;
D788,105 by Heck et al.;
CN2014/10363735 by Wang;
CN2016/21101338U by You Yanhongl
KR2016/0064891 by Kim Dong;
CN2016/10407204 by Chen LLiang;
US2015/0948093 by Edwards et al.;

EP2015/0189974 by Tshushima Teppei;
US2016/0340576 by Smith;
US2016/0579916 by Strebe;
US2015/0850717 by Pluemer;
CN2018/2134273 by Gengzangduojie;
CN2016/20753049U by Zheng Yong;
JP1988/0097255U by Chen Liang;
US2015/0948093 by Edwards;
US2015/0189975 by Tsushima Teppi;
US2015/0249819P by Smith;
US2016/171777P by Strebe;
US20154/0048764P by Edwards;
CN2018/213342738U by Gengzanjduojie;
CN2016/20753049U by Zheng Yong;
JP1988/0097255U;
CH1981/0005463 by Gaigaa et al.;
GB1999/0002481 by Phillips.

Publications identified by the Examiner in prosecution of parent application Ser. No. 16/602,776 are:

2018/0213895 by Green;
2015/0296963 by Byun;
2009/0207710 by Jacques;
2015/0085623 by Modaragamage;
2016/0249712 by Pluemer;
2019/0064743 by Clark;
2016/143403 by Pluemer;
U.S. Pat. No. 2,749,634 to Billett;
U.S. Pat. No. 3,924,304 to Grandmont; and
U.S. Pat. No. 9,439,480 to French.

It is generally gleaned from a study of the numerous known references that many embodiments of the general idea of incorporating two watched, or medallions etc. in a single band are known. Even in view thereof, there remains a need for a single watchband system that allows users to wear both a conventional watch, and smartwatch of their choice, both secured by a single watchband in a compact functional fashion. In particular there remains a need for a method of deploying such a system that is user friendly to practice, which system and method enables the use of a single smartwatch in functional combination with a plurality of conventional watches, each associated with a different watchband.

DISCLOSURE OF THE INVENTION

The present invention recognizes the existing situation illuminated in the Background Section of this Specification, and in response teaches a watchband that enables user selection of watches that are affixed thereto, either directly or indirectly (via for instance, a buckle affixed to the single watchband into which at least the smartwatch is affixed). It further offers the capability of making it quick and easy to affix, and remove, at least the smartwatch from a present invention watchband, which, in the preferred embodiment, does not require tools. The capability offered by the present invention enables a user to, for instance, maintain a number of conventional watch-watchband systems, and variously affix a single smartwatch sequentially therebetween via an insertion. This capability overcomes what can be a problem resulting from having a dedicated smartwatch affixed on a watchband along with a conventional watch. Said problem being that while wearing one system, information which is received by the associated smartwatch is not easily available to a smartwatch associated with another system, although multiple smartwatches can be made to forward information received or generated thereby to a common additional system via an electronic network (eg. the Internet).

A present invention then comprises means for securing at least two watches on a single watchband, directly or indirectly, at least one of said at least two watches being a smartwatch, said smartwatch being mounted directly or indirectly to said single watchband in a way which allows quick and easy affixing and removal thereof.

Said watchband can provide that said smartwatch is removably mounted by insertion into a cavity in said watchband. Said watchband can alternatively provide that said smartwatch is mounted to said watchband by means of a buckle system which is affixed to said watchband. That is, said cavity can be formed by or extend into a smartwatch buckle system as well, or be exclusively present in said buckle system. In a preferred embodiment the cavity is formed in a buckle system which comprises three elements, one end of the first element and one end of a third element being rotatably affixed to first and second ends of a watchband, and second ends of said first and third elements being rotatably affixed to first and second ends of said second element.

In addition, the smartwatch can be present in a retainer therefore which is affixed to said single watchband.

In a preferred embodiment the watchband is securely attached to a conventional watch.

Further, the present invention can include an insertable blank which is substantially of the same dimensions of a smartwatch. In use, when a smartwatch is not present the insertable blank can be placed into the cavity for aesthetic (including having engravings thereupon etc.), as well as functional reasons, (eg. the securing blank might comprise a volume into which objects can be placed, such as pills).

While not preferred, it is noted that a magnet or screws can also be involved in a functional way to directly or indirectly secure the smartwatch to the single watchband.

Said smartwatch can be secured to the single watchband by placement into a cavity which is positioned so that said at least two watches are substantially parallel, or perpendicular, to one another depending on where the cavity is located in the watchband directly, or via a buckle.

Of particular importance is a present invention method of enhancing the application of smartwatches while preserving the use of conventional watches comprises the steps of:

a) providing first and second systems, each said system comprising:
   - a single watchband comprising means for directly or indirectly securing at least two watches to a user's wrist, at least one of said at least two watches being a smartwatch, said smartwatch being directly or indirectly mounted to said single watchband in a way which allows quick and easy affixing and removal thereof;

b) affixing said smartwatch to the first of said systems; and c) removing said smartwatch from said first of said systems and affixing it to the second system.

The method is characterized in that information is entered into the same smartwatch when it is in either of the first and second systems. Information received can include downloads from the Internet, or perhaps heartbeat and blood pressure indicators detected by sensors in the smartwatch, which can be relayed to another device.

A preferred embodiment provides that two watches are present and are secured such that said two watches are oriented with respect to one another exclusively and non-adjustably as a selection from the group consisting of:

- substantially parallel; and
- substantially perpendicular;

when said watchband is in-place on a user's wrist, during use.

Said smartwatch is then removably mounted by insertion into a cavity present in a selection from the group consisting of:

- in said single watchband;
- in a retainer therefore affixed to said single watchband;
- in a buckle affixed to said single watchband while it is secured in-place on a user's wrist;
- in both said single watchband and a buckle affixed thereto while it is secured in-place on use on a user's wrist.

In particular, when a buckle is present and a smartwatch is secured to a watchband thereby, only of the smartwatch positions enabled by the buckle that place the two watches either parallel or perpendicular to one another are relevant. Such positioning occurs when the present invention is in use and securing the watches to a user's wrist. The identified relative watch orientations are better described in the Detailed Description Section of this Specification, in conjunction with the Drawings.

It is also noted that the method can involve that at least some information received, (and/or generated) information is sent-on (transmitted) by said smartwatch, to another device via an electronic network, (eg. the Internet).

The Method of the present invention is primarily focused on the use of a single smartwatch in different bands, at different times. It is believed that said limitation is in and of itself Patentable no matter how said smartwatch is attached to the watchbands.

Said method typically comprises, between steps b) and c), a user wearing said first system on his or her wrist for at least a minute. And it is to be appreciated that step c) can involve placing a blank into the first of said systems once the smartwatch is removed therefrom, or may require removal of a blank from said second system before the smartwatch is inserted thereinto.

Said method can involve the smartwatch being secured directly or indirectly to the single watchband by placement into a cavity. The cavity can be in the single watchband, or in a buckle associated therewith, or both a watchband and cavity forming buckle. In one embodiment the cavity is formed in a buckle which comprises a system of three elements, one end of the first element and one end of a third element being rotatably affixed to first and second ends of a watchband, and second ends of said first and third elements being rotatably affixed first and second ends of said second element. Said buckle is better described in the Detailed Description Section of this Specification, in conjunction with the Drawings.

It is noted that the Smartwatch can include a detectable aspect, (eg. a marking or physical attribute which can be observed visually and/or via touch), to aid a user in positioning it "upright" in the securing element, where "upright" means that it is oriented so the user can observe it directly and easily.

Said method can involve that the smartwatch is secured to the single watchband by placement into a cavity which is positioned so that said at least two watches are substantially parallel, or perpendicular, to one another depending on where the cavity is located in the watchband directly, or via a buckle.

As alluded to, said method can further comprise securing a blank in said cavity when a smartwatch is not present therein. It is noted that the securing blank might comprise a volume into which objects can be placed, such as pills.

The present invention will be better understood by reference to the Detailed Description Section of this Specification, with reference to the Drawings.

BRIEF DESCRIPTION OF THE DRAWINGS

FIG. 2A' shows a non-limiting side view of an embodiment of a present invention watchband with a smartwatch present in a cavity therein perpendicular to a conventional watch.

DETAILED DESCRIPTION

Figure 1:
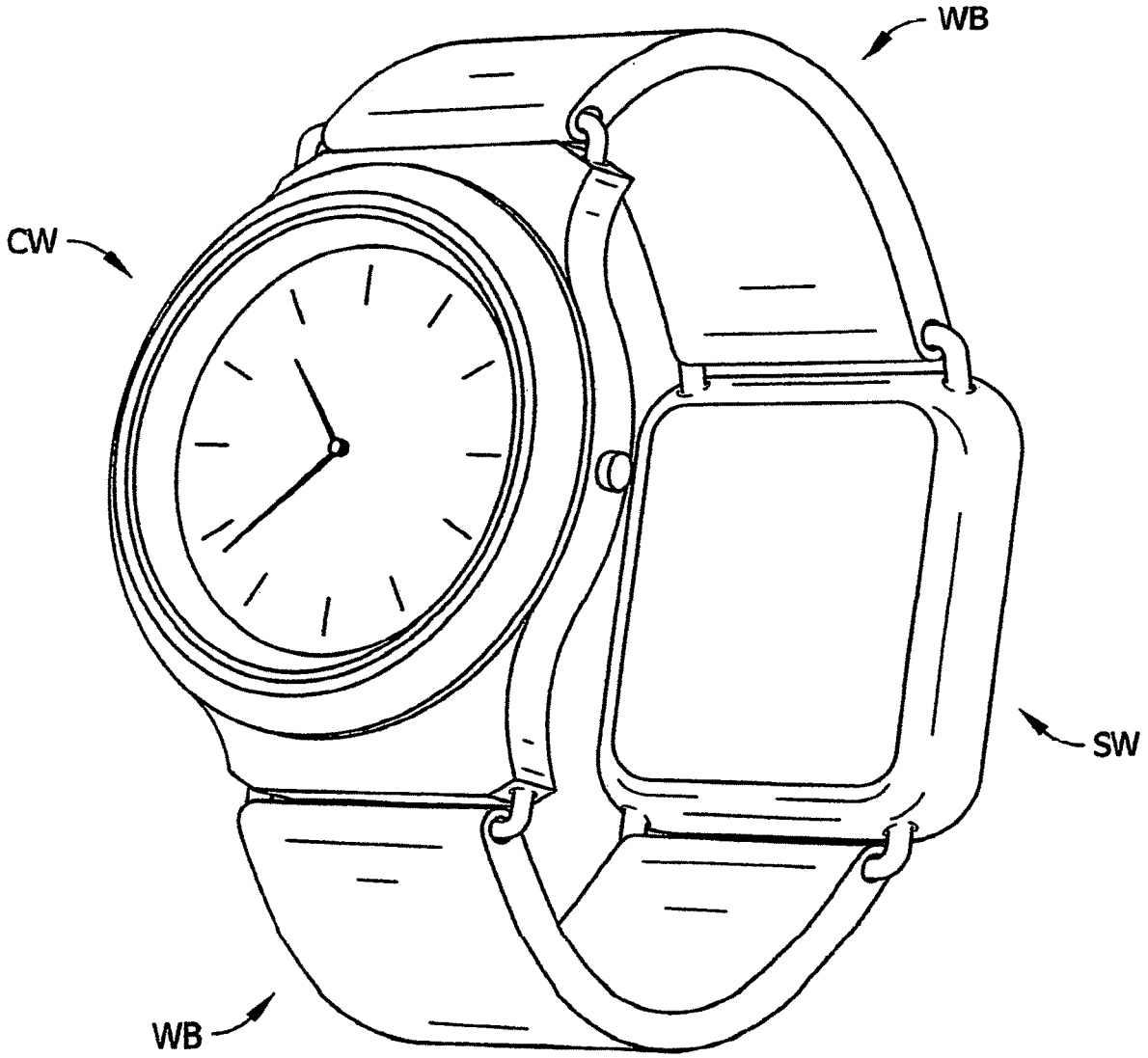
Fig. 1 PRIOR ART
FIG. 1 demonstrates a prior art single watchband that secures both a conventional watch and a smartwatch.

Turning now to the Drawings, FIG. 1 shows a prior art combination of a conventional (CW) and a smartwatch (SW) secured to one another by a single watchband (WB), which enables a user to wear both on his or her wrist. While providing utility, it is noted that the shown system might be considered to be a bit bulky and not streamlined. That is, aesthetically, it could be enhanced.

Figure 2A:
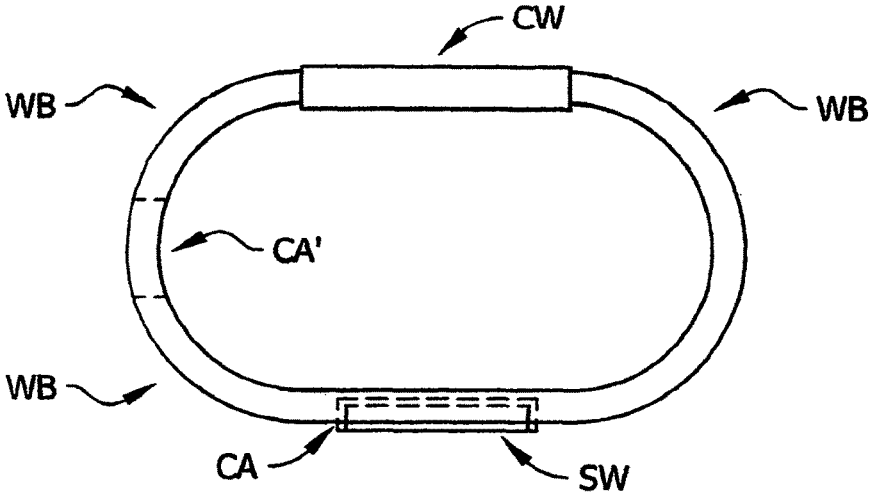
FIG. 2A shows a non-limiting side view of an embodiment of a present invention watchband with a smartwatch present in a cavity therein, parallel to a conventional watch.

FIG. 2A is shows a non-limiting side view of an embodiment of a present invention watchband (WB) with a smartwatch (SW) present in a cavity (CA) therein. Note also the indication of a possible cavity (CA') on a side of the Watchband (WB). In one embodiment of the invention a Smartwatch is present in said cavity (CA') in addition to, or instead of being present in cavity (CA). (This is further shown in FIG. 2*a*'). Further, where one Cavity (CA) or (CA') is present, the other can be, but need not be present. Note, (CA') as shown in FIG. 2A is appropriate for wearing on a right arm wrist. For a left wrist the cavity (CA) would preferably be on the right side of FIG. 2A. Note that, depending on the location of the Cavities (CA) and (CA') the smartwatch (SW) is secured to the single watchband (WB) by placement into a cavity which is positioned so that said at least two watches are substantially parallel (CA) to one another, or substantially perpendicular (CA') to one another. Positions in between parallel and perpendicular are also within the scope of the present invention, but are not preferred. FIG. 2A' is included to show a non-limiting side view of an embodiment of a present invention watchband with a smartwatch (SW) present in a cavity (CA') therein, which cavity *CA;) is substantially perpendicular to a conventional watch (CW). (Note FIG. 2A' shows the situation for both right and left arms).

Figure 2B:
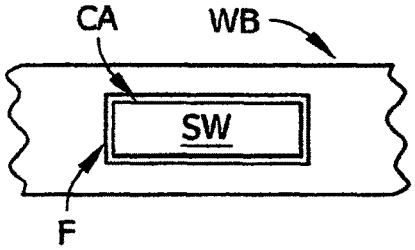
FIG. 2B shows a non-limiting bottom view of an embodiment of a present invention watchband with a smartwatch present in a cavity therein.

FIG. 2B shows a non-limiting view of an embodiment of a present invention watchband (WB) with a smartwatch (SW) present in a cavity (CA) (or alternatively (CA')) therein. Note also the indication of a Frame (F) which can optionally be present around the perimeter of the Cavity shown as (CA), (or (CA'). When present, Frame (F) serves to secure the Band against degradation in the size and shape of said Cavity.

Figure 2C:
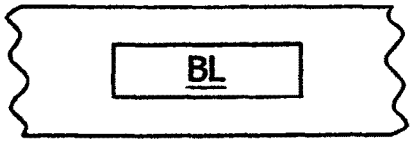
FIG. 2C shows a non-limiting bottom view of an alternative embodiment of a present invention watchband with a blank present in a cavity therein.

FIG. 2C shows a non-limiting view of an alternative embodiment of a present invention watchband (WB) with a blank (BL) present in a cavity (CA) (or CA') therein. When a Smartwatch (SW) is not present in a Cavity (CA) (CA') a Blank (BL) can be present for aesthetic and other reasons, such as providing a cavity for containing pills or the like.

Figure 2D:
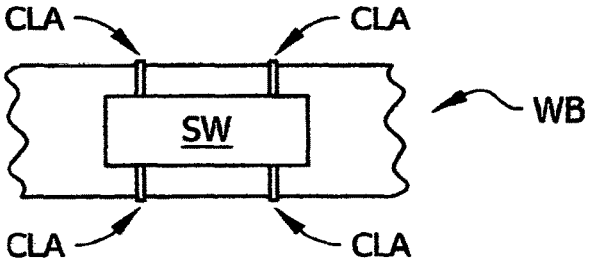
FIG. 2D shows a non-limiting bottom view of an alternative embodiment of a present invention watchband with a smartwatch secured by clasps.

FIG. 2D shows a non-limiting bottom view of an alternative, non-preferred, embodiment of a present invention watchband (WB), with a smartwatch (SW) secured by clasps (CLA) which secure to the outside of a Watchband (WB).

Figure 2E:
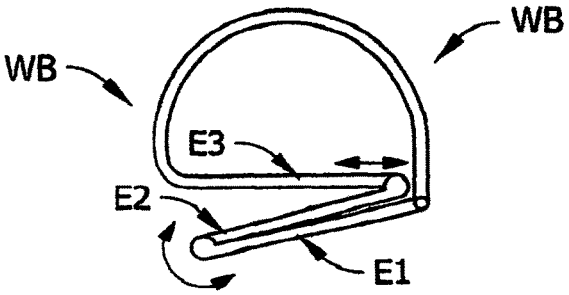
FIG. 2E shows a side view of a watchband buckle in an open position.
Figure 2F:
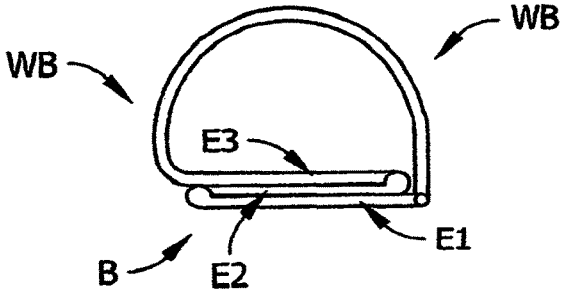
FIG. 2F shows a side view of a watchband buckle in a closed position.
Figure 2A:
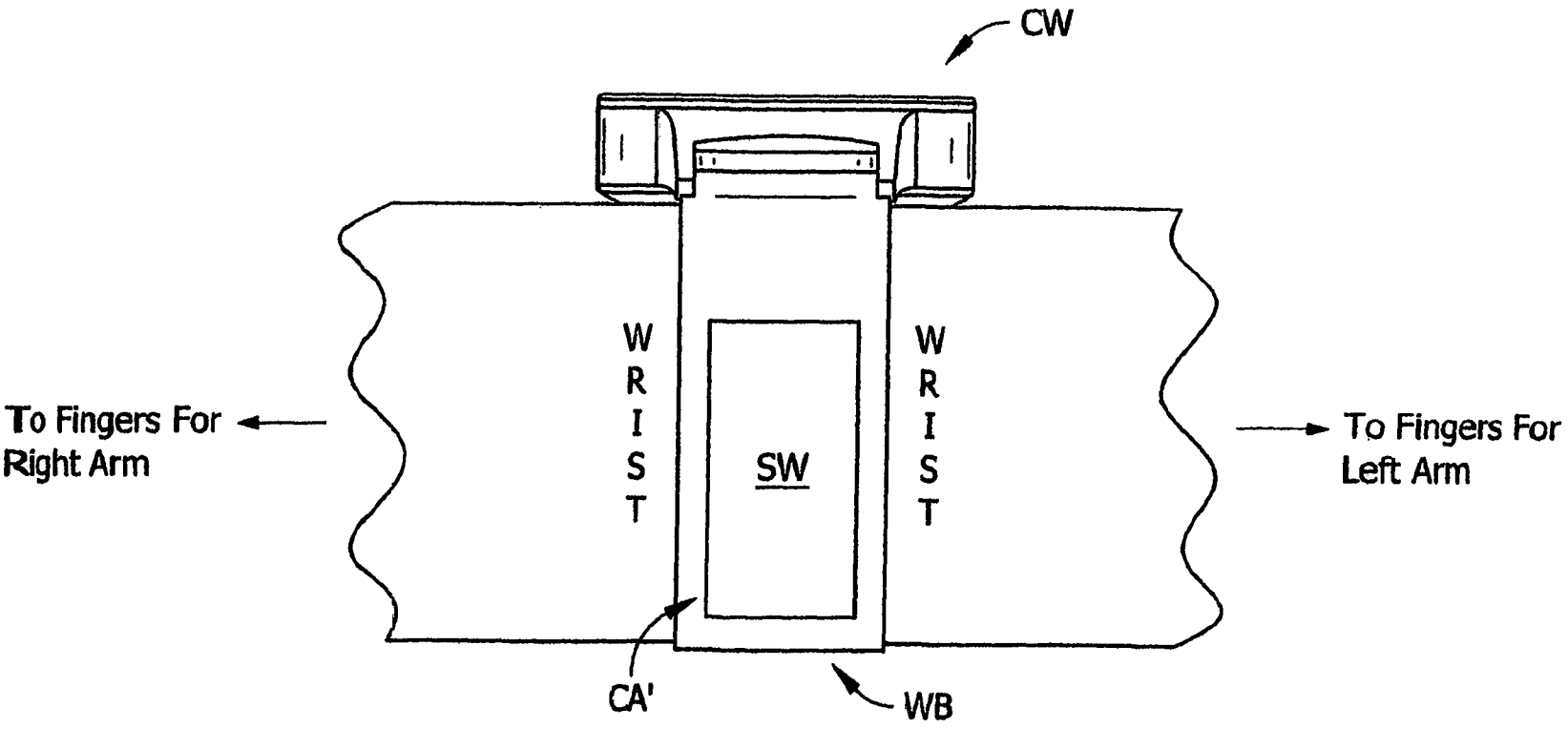

To introduce the preferred embodiment of the present invention, FIG. 2E is provided to demonstrate a side view of a watchband buckle (B) in an opening position. FIG. 2F demonstrates a side view of a watchband buckle (B) in a closed position. Note that the buckle (B) system comprises three elements (E1) (E2) and (E3), one end of the first element (E1) and one end of the third element (E3) being rotatably affixed to first and second ends of a watchband (WB), and second ends of said first (E1) and third (E3) elements being rotatably affixed to first and second ends of said second element (E2). It is to be understood that other buckle configurations can also be applied within the scope of the present invention.

FIGS. 2A-2F are to be interpreted as disclosing the present invention with a broad brush. FIGS. 3A-3K show preferred embodiments of the present invention which utilize watchband buckles (B), although FIGS. 2A-2C are also to be considered to be preferred regarding placement of cavities (CA) and/or (CA').

Figure 3A:
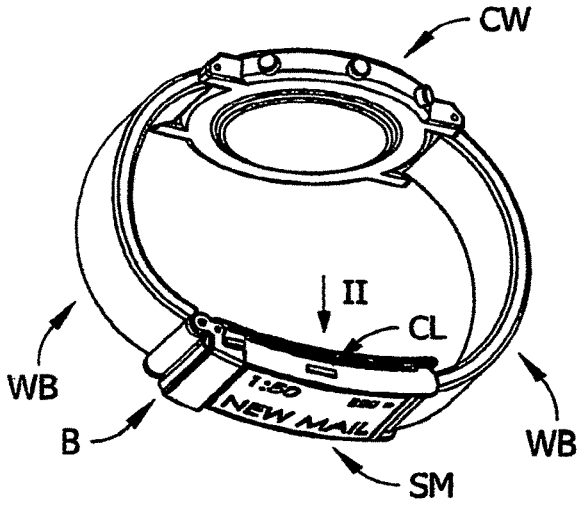
FIG. 3A shows a present invention with a smartwatch inserted from the inside of a buckle.

FIG. 3A shows a present invention with a smartwatch (SW) inserted from the inside (II) of a buckle (B).

Figure 3B:
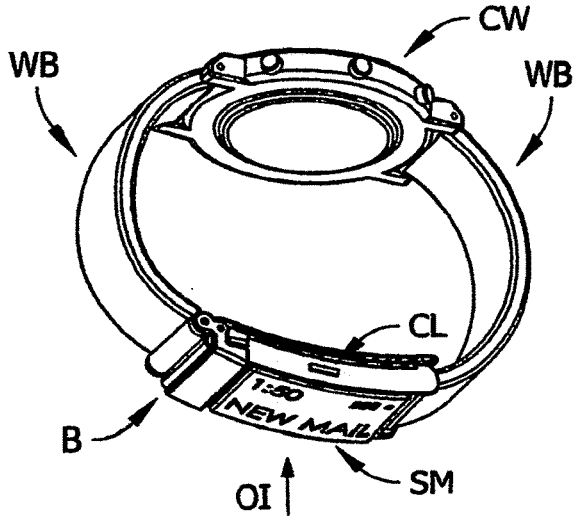
FIG. 3B shows a present invention with a smartwatch inserted from the outside of a buckle.

FIG. 3B shows a present invention with a smartwatch (SW) inserted from the outside (OI) of a buckle (B).

Figure 3C:
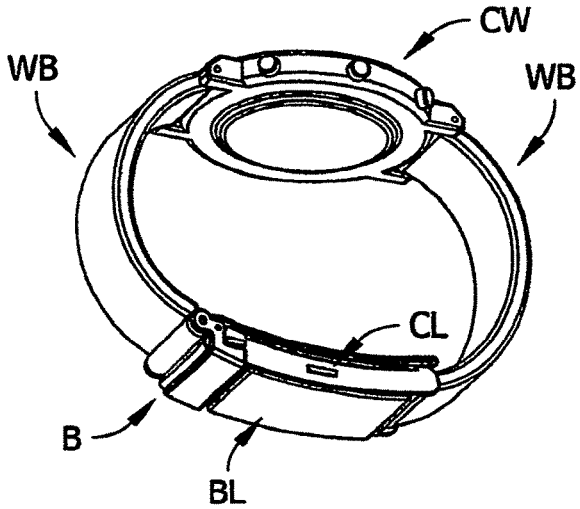
FIG. 3C shows a present invention with a blank inserted instead of a smartwatch.

FIG. 3C shows a present invention with a blank (BL) inserted instead of a smartwatch, for use when a smartwatch (SW) is not present.

Figure 3D:
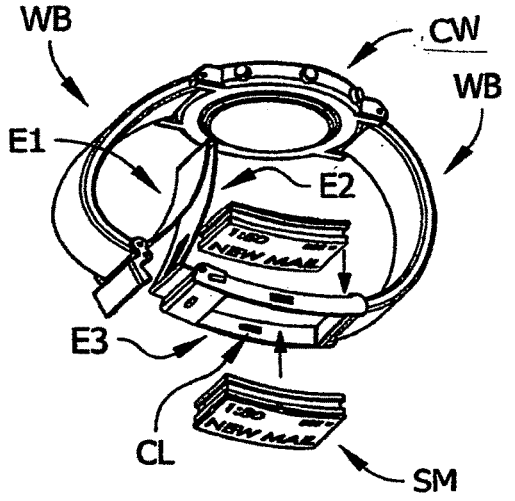
FIG. 3D shows a present invention with the buckle open, including indication of a smartwatch being entered from both from the outside and inside of a buckle.

FIG. 3D shows a present invention showing how the buckle (B) (see FIG. 2F) opens up to allow insertion and removal of a smartwatch (SW) or blank (BL). Note that element (E1) (E2) and (E3) as shown in FIGS. 2E and 2F are shown for coordination between those Figures and FIGS. 3A-3D. Note in particular that the smartwatch (SM) is always oriented parallel to the Conventional Watch (CW) when in use on a user's wrist. It is possible that the smartwatch (SW) could be oriented other than Parallel to the Conventional Watch (CW) while it is being installed, but in use on a user's wrist it is oriented substantially Parallel to the Conventional watch (CW). The Examiner, in Examination of the parent application Ser. No. 16/602,776 cleverly identified that possibility as the basis for rejecting the Claim to mounting the smartwatch (SW) by such a Buckle (B) formed from elements (E1) (E2) and (E3) where the requirement of "parallel" was recited. The Examiner argued that the Specification did not clearly support the Claim. Herein that objection is believed overcome by the further limiting language to the effect that "while in use" with the combination conventional watch (CW), smartwatch (SW) and band (WB) is on a user's wrist the conventional watch (CW) and smartwatch (SW) are substantially parallel to one another. Claims now contains, for instance, the language "in a buckle affixed to said single watchband while secured in-place on a user's wrist", to specifically avoid the non-parallel possibility during entry of a smartwatch into said buckle. In other words, it is the parallel orientation between the conventional (CW) and smartwatch (SW) shown in FIG. 3D which is being Claimed. When said condition is not met, such as during installing a smartwatch (SW) into the buckle (B) which comprises elements (E1), (E2) and (E3), the Claims do not cover the situation. But when in use on a user's wrist, and the parallel orientation between the conventional watch (CW) and the smartwatch (SW) is met, regardless of any intermediary non-parallel orientations, the Claims cover the system described.

Figure 3E:
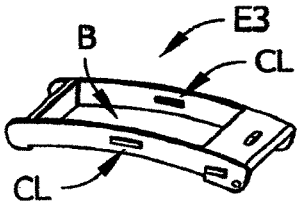
FIG. 3E shows a present invention partial buckle.

FIG. 3E shows a partial present invention buckle (B) with a smart watch insert retainer press button latches (CL) for insert securing a smartwatch (SW).

Figure 3F:
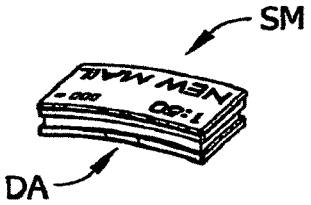
FIG. 3F shows a smartwatch constructed for front insertion.

FIG. 3F shows a smartwatch constructed for Smart watch outside insertion. In particular, note slight overhang around display top to prevent push-through, and also showing groove around center area for general simplified means to retain insert as designers wish. FIG. 3F also shows a detectable (DA) aspect of a smartwatch (SW) which can aide with insertion into a watchband (WB) cavity when in dim lighting, for instance. The detectable (DA) aspect can be simply a visible marking, or can be a physical attribute embedded in the smartwatch.

Figure 3G:
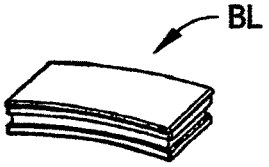
FIG. 3G shows a blank constructed for front insertion.

FIG. 3G shows a blank (BL) constructed for outside insertion when smart watch insert is not desired to be used.

Figure 3H:
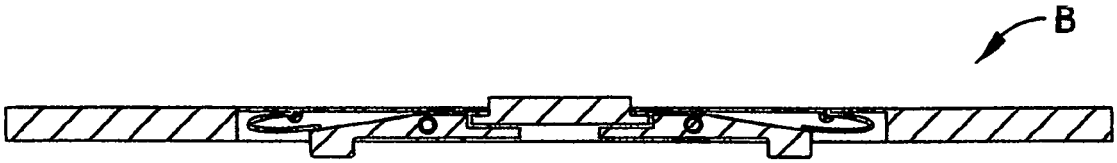
FIG. 3H shows a cut-away view of one side of a latching mechanism.

FIG. 3H shows a cut-away view of an exemplary latching mechanism (B).

Figure 3I:
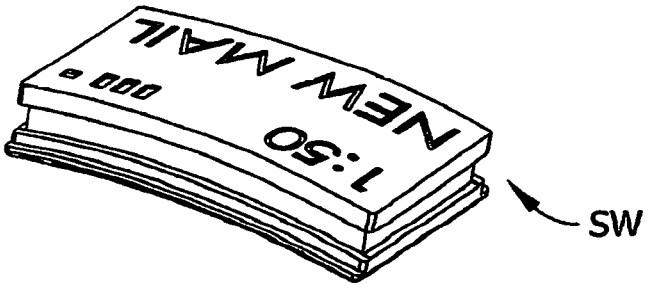
FIG. 3I shows a smartwatch constructed for back insertion.

FIG. 3I shows a smartwatch SW) or blank (BL) for inside insertion (II), showing groove around center area for general retention thereof Note the retaining overhang to prevent push-out is on bottom of this insert.

Figure 3J:
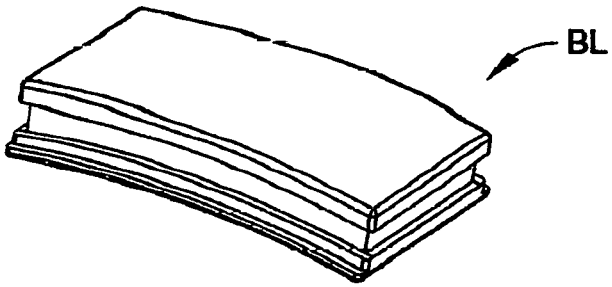
FIG. 3J shows a blank constructed for back insertion.

FIG. 3J shows a blank (BL) constructed for back inside insertion when smart watch insert is not desired to be used.

It should be appreciated that the Drawings are demonstrative only, and not limiting. As indicated by FIGS. 2A-2F, any approach to removably securing a smartwatch (SW) to a single watchband, (to which is also affixed a conventional watch (CW)), is to be considered within the scope of the present invention. Preferred mechanisms for affixing a smartwatch (SW) allow quick and easy affixing and removal, and therefore easy transfer between different systems of single watchband (WB) and conventional watch (CW) systems. It is also within the scope of the present invention to make both the smartwatch and conventional watch easily removable from a watchband. Where two or more conventional watches comprise substantially the same means for affixation to a watchband, this might provide utility.

The terminology "conventional" has been used herein to identify non-smartwatches. The most common conventional watch is mechanical. The term "conventional" can be interpreted to include hybrid mechanical and electronic watches. Further, a "single" watchband indicates, in the present disclosure, a watchband for wearing on a wrist and arranged to operate with a plurality of distinct conventional watches and smart watches affixed thereto. The single watchband could comprise two separate webs, or chains of links united by a buckle or a clasp, or a continuous loop of elastic material, or any other suitable structure capable of being worn on a wrist, to which conventional and and smart watches can be affixed. The defining attribute is that both a conventional and a smartwatch are affixed thereto, with at least the smartwatch being removably so.

Finally, it is within the scope of the present invention to provide two smartwatches in a single watchband (WB). For instance, what is labeled (CW) in, for instance, FIGS. 3A-3D, could be a second smartwatch (SW). And, it is noted that a watchband is sometimes referred to as a wristband, but in the present invention watchband is preferred as the band must secure at least two watches two a user's wrist.

Having hereby disclosed the subject matter of the present invention, it should be obvious that many modifications, substitutions and variations of the present invention are possible in view of the teachings. It is therefore to be understood that the invention may be practiced other than as specifically described, and should be limited only in its breadth and scope only by the Claims.

I claim:

1. A single watchband comprising a system of elements for securing at least two watches, directly or indirectly, to a user's wrist, at least one of said at least two watches being a smartwatch, said smartwatch being removably secured directly or indirectly to said single watchband in a way which allows quick and easy affixing and removal;

wherein two watches are present and are secured such that said two watches are oriented with respect to one another exclusively and non-adjustably as a selection from the group consisting of:

substantially parallel; and substantially perpendicular;

when said watchband is in-place on a user's wrist.

2. A single watchband as in claim 1, in which said smartwatch is removably mounted by insertion into a cavity present in a selection from the group consisting of:

in said single watchband;

in a retainer therefore affixed to said single watchband;

in a buckle affixed to said single watchband while it is secured in-place on a user's wrist;

in both said single watchband and a buckle affixed thereto while it is secured in-place on use on a user's wrist.

3. A single watchband as in claim 2, which further comprises a blank that is insertable into said cavity when a smartwatch is not present therein.

4. A single watchband as in claim 3, wherein said blank comprises a volume therein for containing objects.

5. A single watchband as in claim 1, in which said smartwatch is mounted to said watchband by a system of elements comprising a cavity forming buckle.

6. A single watchband as in claim 5, in which the cavity forming buckle comprises a system of three elements, one end of the first element and one end of a third element being rotatably affixed to first and second ends of a watchband, and second ends of said first and third elements being rotatably affixed to first and second ends of said second element.

7. A single watchband as in claim 1, in which one of said at least one watch is not a smartwatch which is permanently, or removably secured to said watchband.

8. A single watchband as in claim 1, in which the smartwatch is secured to the single watchband by placement into a cavity which is positioned so that said at least two watches are substantially parallel to one another.

9. A single watchband as in claim 1, in which the smartwatch is secured to the single watchband by placement into a cavity which is positioned so that said at least two watches are substantially perpendicular to one another.

10. A single watchband as in claim 1, in which the smartwatch includes a marking on it which can be observed visually and/or via touch, to aid a user in positioning it "upright" in the securing element, where "upright" means that it is oriented so the user can observe it directly and easily.

11. A method of enhancing the application of smartwatches while preserving the use of conventional watches comprising the steps of:

a) providing first and second separate systems, each said system comprising:

a single watchband comprising a system of elements for securing at least two watches to a user's wrist, directly or indirectly, at least one of said at least two watches being a smartwatch, said smartwatch being removably secured to said single watchband in a way which allows quick and easy affixing and removal thereof;

wherein two watches are present and are secured such that said two watches are oriented with respect to one another exclusively and non-adjustably as a selection from the group consisting of:

substantially parallel; and substantially perpendicular;

when said watchband is in-place on a user's wrist;

b) directly or indirectly affixing said smartwatch to the first of said systems; and c) removing said smartwatch from said first of said systems and directly or indirectly affixing it to the second system;

said smartwatch receiving information at least once during the system configurations in both steps b) and c), with the result being that all information received, is received by the same smartwatch.

12. A method as in claim 11, which further comprises, between steps b) and c), a user wearing said first system on his or her wrist for at least a minute.

13. A method as in claim 12, which further comprises securing a blank in said cavity when a smartwatch is not present therein.

14. A method as in claim 11, in which the smartwatch is secured to the single watchband by placement into a cavity therein.

15. A method as in claim 11, in which the smartwatch is secured to the single watchband substantially parallel to said second watch by placement into a cavity in a buckle affixed to said single watchband.

16. A method as in claim 15, in which said cavity in said buckle is comprised of a system of three elements, one end of the first element and one end of a third element being rotatably affixed to first and second ends of a watchband, and second ends of said first and third elements being rotatably affixed to first and second ends of said second element.

17. A method as in claim 15, in which said blank comprises a volume therein for containing objects.

18. A method as in claim 11, in which the smartwatch is secured to the single watchband by placement into a cavity which is positioned so that said at least two watches are substantially parallel to one another.

19. A method as in claim 11, in which the smartwatch is secured to the single watchband by placement into a cavity which is positioned so that said at least two watches are substantially perpendicular to one another.

20. A method as in claim 11, in which the smartwatch includes a marking on it which can be observed visually and/or via touch, to aid a user in positioning it "upright" in the securing element, where "upright" means that it is oriented so the user can observe it directly and easily.

21. A method as in claim 11, in which at least some received information is sent-on by said smartwatch to another device via an electronic network.

22. A method of enhancing the application of smartwatches while preserving the use of conventional watches comprising the steps of:

a) providing first and second separate systems, each said system comprising:

a single watchband comprising a system of elements for securing at least two watches to a user's wrist, directly or indirectly, at least one of said at least two watches being a smartwatch; said smartwatch being removably secured to said single watchband in a way which allows quick and easy affixing and removal thereof;

b) affixing said smartwatch to the first of said, systems; and c) removing said smartwatch from said first of said systems and affixing it to the second system;

said smartwatch receiving information at least once during the system configurations in both steps b) and c), with the result being that all information received, is received by the same smartwatch.

23. A method as in claim 22, in which at least some received information is sent-on by said smartwatch to another device via an electronic network.

* * * * *